United States Patent [19]

Bonanno

[11] Patent Number: 4,468,999

[45] Date of Patent: Sep. 4, 1984

[54] PROGRAMMABLE SYNTHESIZER

[75] Inventor: Carmine Bonanno, Long Island, N.Y.

[73] Assignee: Octave-Plateau Electronics Inc., New York, N.Y.

[21] Appl. No.: 470,716

[22] Filed: Feb. 28, 1983

[51] Int. Cl.[3] ..... G10H 3/00

[52] U.S. Cl. ..... 84/1.1; 84/1.18; 340/365 P

[58] Field of Search ..... 84/1.1, 1.01, 1.18, 84/DIG. 7; 340/365 P, 555, 556, 600; 307/117; 250/338

[56] References Cited

U.S. PATENT DOCUMENTS

| | | | |
|---|---|---|---|
| 3,621,268 | 11/1971 | Friedrich et al. | 340/365 P |
| 3,769,515 | 10/1973 | Clark, Jr. | 340/365 P |
| 4,052,923 | 10/1977 | Cohn | 84/1.18 |
| 4,362,934 | 12/1982 | McLey | 84/1.1 |

*Primary Examiner*—Forester W. Isen

*Attorney, Agent, or Firm*—Karl F. Ross; Herbert Dubno

[57] ABSTRACT

A programmable music synthesizer has a keyboard which also generates an expression signal representing the pressure on the keyboard and utilizes the change in an infrared path length for producing this expression signal.

16 Claims, 6 Drawing Figures

PROGRAMMABLE SYNTHESIZER

FIELD OF THE INVENTION

My present invention relates to a progammable music synthesizer, and more particularly, to a music synthesizer provided with keyboard expression and especially an expression mode sensitive to pressure on the keyboard.

BACKGROUND OF THE INVENTION

Music synthesizers are, of course, known in the art and generally comprise a keyboard provided with a multiplicity of note-selection keys whose switches are connected to various oscillator circuits, filters or like electronic controls, the outputs of which can be combined to form electrically generated tones, chords and voices in the production of music.

Various expression devices are known independently or have been associated with such synthesizers. The term "expression" is here used to refer to a modulation applied to the pure tone or to the voices generated by the instrument and may include, for example, a tremolo or the like which is superimposed upon the output.

In the music synthesizer field it has become desirable to provide a number of expression modes, for example, under the control of a foot pedal, or presenting the velocity as the key is depressed, or generated or controlled by a joystick or other implement.

Of considerable interest is an expression mode which modifies the output as a function of the pressure applied to the keyboard.

Most of the devices provided for this purpose are true pressure-electronic transducers in which an element exposed to pressure and coupled to the keyboard is provided to generate an electrical output which is used to modulate the signal resulting from the operation of the keys. Other systems can be conceived of for this purpose, however, which respond not directly to pressure, but indirectly to pressure because they are activated by movement of the keyboard against, for example, the force of a restoring means such as a spring.

Differential transformers, Hall effect systems and the like have been proposed for this purpose, but have not been successful previously because on the one hand they tend to be too expensive or complex to be readily incorporated into keyboards for music synthesizers of the type described and, on the other hand, tend to be unstable and unreliable, especially with long term use.

OBJECTS OF THE INVENTION

It is the principal object of the present invention to provide an improved expression signal generator, especially a signal generator for keyboard pressure expression, which can be used with an electronic music synthesizer and which overcomes the drawbacks of earlier synthesizers and expression generators as described above.

Another object of this invention is to provide an improved music synthesizer and especially an improved electronic music synthesizer of the programmable type which has an advanced keyboard expression mode.

It is still another object of the invention to provide improved versatility in electronic music synthesizers.

SUMMARY OF THE INVENTION

These objects and others which will become apparent hereinafter are attained, in accordance with the present invention, with a keyboard expression generator which responds to the limited movement of the hinged key-supporting member of a keyboard relative to another member thereof and which includes an infrared radiation source on one of these members directing a beam, pencil or ray of infrared radiation toward the other of these members, a reflective surface or mirror formed on this other member, and an infrared detector or receiver, receiving reflected infrared radiation and disposed on the first mentioned member and including means for generating an electric signal representing at least changes in the intensity of the infrared radiation received by the detector and thereby generating an electrical output representing movement of the movable member relative to the other member against a restoring force, e.g. that of a spring or other elastic element.

Advantageously, the I-R source and detector are disposed side by side in a compact housing as a single module and the I-R source is an infrared emitting diode, i.e. a semiconductive I-R emitter, while the I-R detector is a semiconductive I-R light sensor.

Surprisingly, even the slightest movement of the keyboard can be detected with the means of the present invention, and hence the sensitivity of the expression generator can range from the highest imaginable sensitivity to the lowest which may be desirable.

The module is compact, inexpensive and reliable, and since the only coupling between the two members necessary for effective operation is the I-R beam, and this does not change with time over reasonable life of the keyboard, the system of the invention is extremely reliable and free from the need for constant readjustment or calibration.

I have found it to be advantageous, especially when the keyboard is comparatively long, to provide one such I-R module at each end of the keyboard and to combine the signals from the two, e.g. in a summing amplifier, in order to generate the expression signal which is fed to the electronics of the synthesizer.

The improved expression generator of the invention is best used with an advanced monophonic or polyphonic program synthesizer of the VOYETRA TM series marketed by Octave-plateau Electronics Inc.

Advantageoulsy, the keyboard is connected to the electronic circuitry of the synthesizer via a simple three-conductor microphone cable utilizing the conventional audio plugs and jacks associated with such cables. In this case, it has been found to be advantageous to provide the keyboard with a discriminator circuit which can break down the spike-carrying direct current input of one of the cable lines to a direct current power signal supplying direct current to the circuit elements of the keyboard, and one or more trains of pulses forming clock and control pulses for the digital transmission of data from the keyboard to the synthesizer circuit. The data is transmitted over another line of the microphone cable while the third line is a ground common to both the power/control line and the data line.

According to another feature of the invention, the output from the summing amplifier into which the I-R modules feed the respective signals is delivered to a mixer through a selector switch of the synthesizer, which when closed, feeds the I-R module expression mode to the system. Other selector switches can connect additional expression inputs representing, for example, velocity, joystick position, pedal operation or the input from a noise generator to the mixer.

Advantageoulsy, moreover, the output of the mixer is applied to the control input of a voltage controlled amplifier connected between a source multiplexer and a destination multiplexer, both of which can be programmed in accordance with the principles of the VOYETRA One TM or VOYETRA Eight TM devices. Advantageously, between the source-select and the destination-select circuitry an additional voltage controlled amplifier is provided to which a control signal can be fed to represent the modulation depth.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
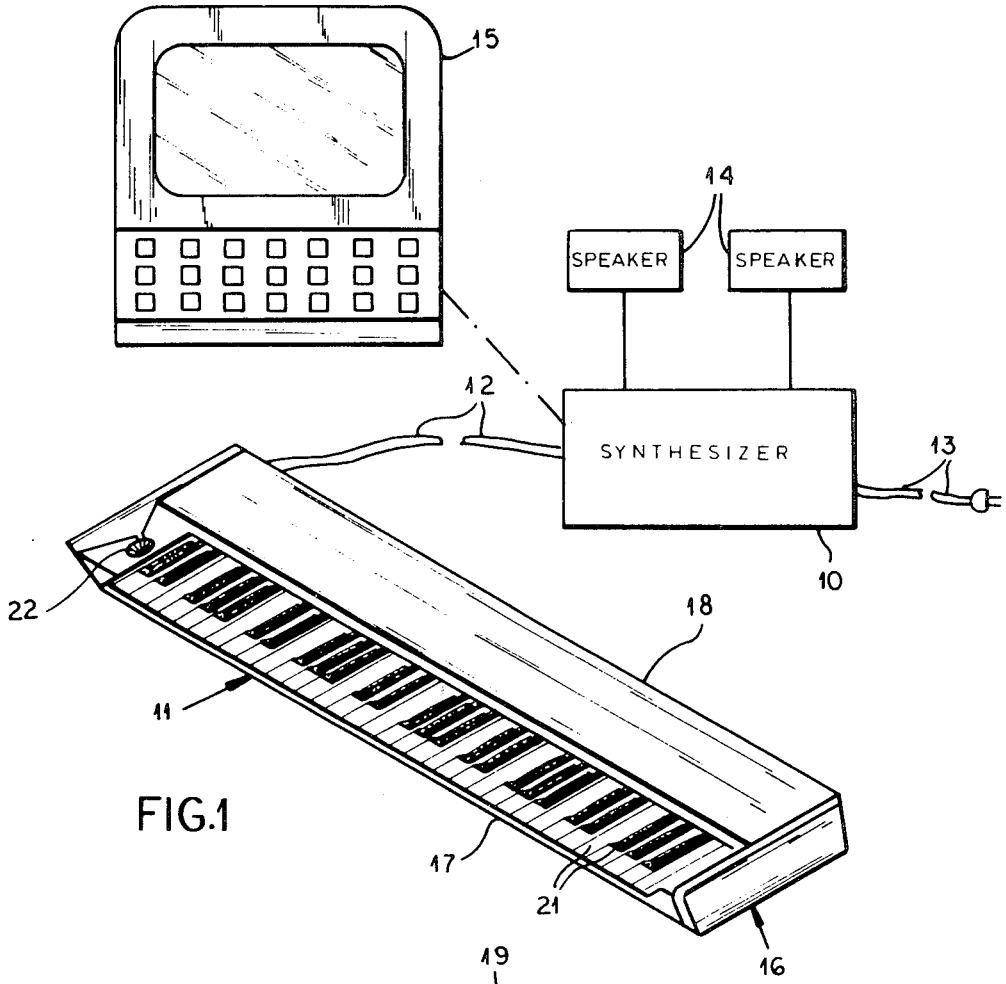
FIG. 1 is a diagram illustrating basic elements of the system of the invention.

In the drawing I have shown a programmable monophonic or polyphonic music synthesizer 10 which is connected to a keyboard module 11 by a three-wire microphone cable 12, and conventional audio plugs and jacks (not shown), the synthesizer 10 containing all of the circuitry with the exception of the keyboard circuitry required to operate the instrument and being connectable to a conventional line current source by the wire 13.

The synthesizer may be provided with various output devices represented by the loudspeakers 14. In general, the synthesizer can also be coupled to an electronic computer operated with a microprocessor such as the microcomputer 15 which has been illustrated diagrammatically, or to say any other computer provided with appropriate interfacing.

The synthesizer is associated with memory so that programmed settings can be recalled and programmed music can be stored.

In place of the keyboard, of course, other inputs of an instrumentation type may be applied.

The keyboard 11 comprises a housing 16 which can include a base 17 and a fixed upper member 18 below which a key-carrying plate 19 (not seen clearly in FIG. 1) may be hingedly mounted via the hinge 20.

The plate 19 carries the note selection keys 21 which can be provided with respective switches for controlling the sound generators of the synthesizer in a manner known per se and outside the scope of the present invention. The keyboard also can be provided with a joystick 22 which can be operated by the left hand of the musician to contribute additional expression and, of course, pedals and other means can be provided to contribute still other expression modes to the instrument.

Figure 2:
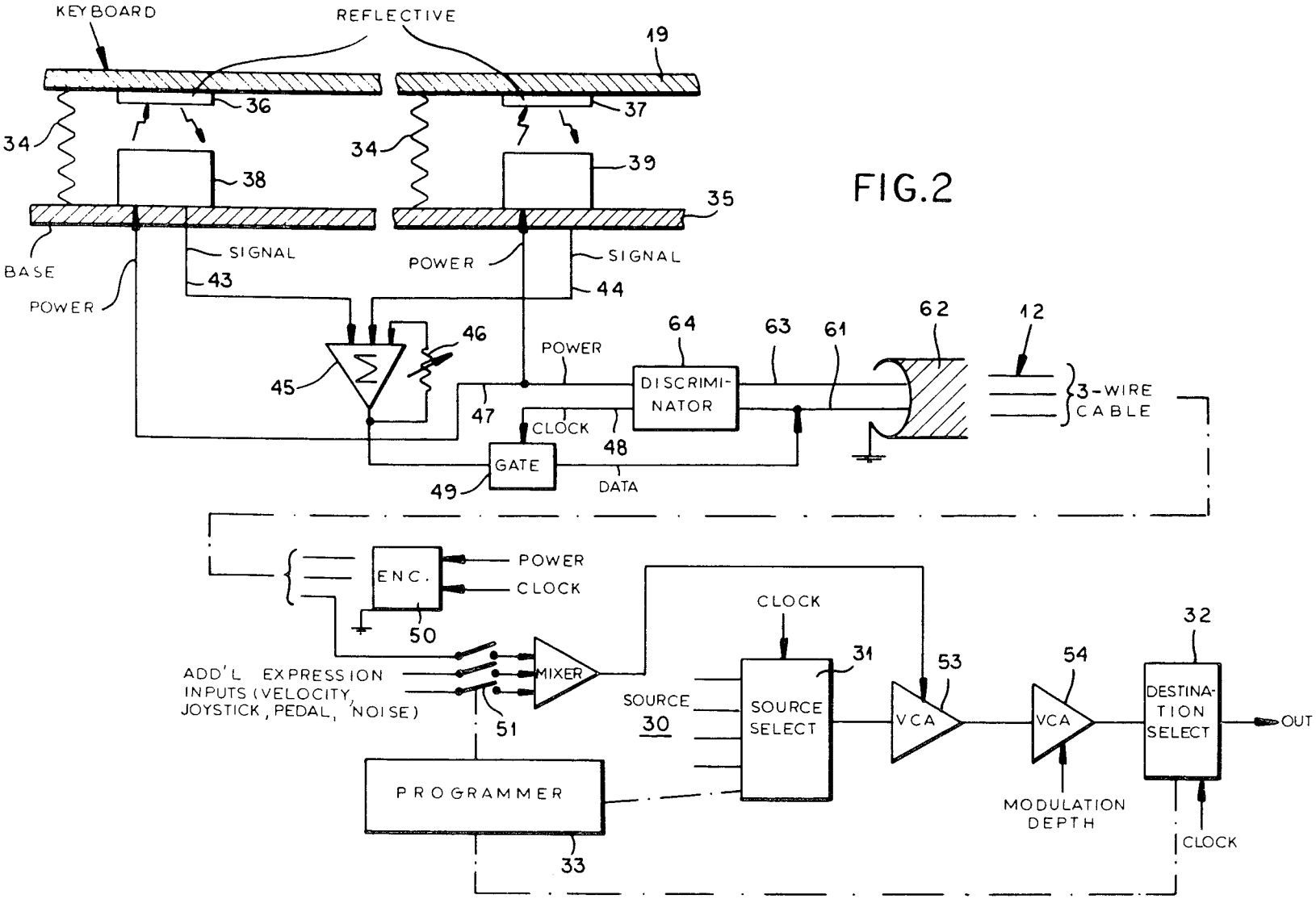
FIG. 2 is a detail view partially in cross section longitudinally to the keyboard, but mainly in clock diagram form, illustrating the invention.

While the principles of music synthesizers are by now well known and hence need not describe all of the aspects of tone generation and the like which are involved, it can be seen from FIG. 2 that basically the synthesizer can comprise a number of sources represented generally at 30 and consisting, for example, of various voltage controlled oscillators producing signals of different frequencies and signals of different wave form which, through a source select multiplexing circuit 31 are ultimately fed to a destination select multiplexing circuit 32 from which these signals can be delivered to any conventional mixing or output stage. For convenience, the fact that the source and destination select are programmable and that the system is digitally operated except for the voltage controlled oscillators and amplifiers which have been and will be described herein, is represented by the blocks 33, i.e. the program facility.

As far as the present improvement is concerned, it can be seen that the hinged keyboard member 19 can be spring biased into its normal position, e.g. by springs 34 relative to a fixed member 35 of the keyboard and that on opposite longitudinal ends of the keyboard, the movable member 19 is provided with reflective surfaces 36 and 37 which are juxtaposed with I-R modules 38 and 39, respectively.

Figure 3:
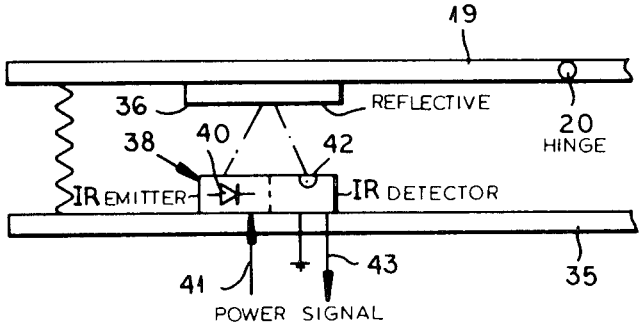
FIG. 3 is a transverse section through the keyboard, also in somewhat diagrammatic form.

As can be seen from FIG. 3, each module 38 or 39, can comprise an I-R emitter 40 of the semiconductor or LED type, supplied with power by a line 41, and a diagrammatically illustrated semiconductor I-R detector 42 which generates an output signal which is delivered by line 43. The two parts are provided side by side in a common housing or module structure and can be mounted either on the fixed member or on the movable member, although in the embodiment illustrated, they are mounted on the fixed member 35 and juxtaposed with the movable member 19.

The output of the I-R detector is proportional to intensity of the reflected infrared radiation and is inversely proportional to the square of the path length of the I-R radiation. The detector thus senses the change of length resulting from movement of member 19 as the keys are played.

Reverting to FIG. 2, it can be seen that the output signal from line 43 and module 38 and the output signal of line 44 from module 39 are delivered to a summing amplifier 45 which can have a gain control 46 forming a sensitivity setting potentiometer directly on the keyboard and preferably below the joystick whereby the response of the keyboard to finger pressure may be set. This response can range from a high response at the smallest touch to a small response with the most heavy-handed playing.

The output of the semiamplifier 45 is transmitted on a data line 61 of a three-wire microphone cable represented by the cable 12 previously mentioned. This data line is one of the three conductors of the cable, another of which is grounded as represented at 62, while the third is the power and control line 63. The power and control signals are separated in a discriminator 64 (see FIG. 4) into D.C. power which is supplied via line 47 inter alia to the I-R emitters of the modules 38 and 39. The control output from the discriminator is represented as a clock line 48 which triggers a gate 49 delivering the data representing the keyboard pressure expression mode to the synthesizer.

At the synthesizer, the power inputs and the clock or control inputs to the cable are combined in a mixer 50.

The keyboard pressure expression output is delivered via a set of selector switches 51 to a mixer 52. The latter also receives, via appropriate switches of the bank 51, the additional expression inputs representing key velocity, joystick position, pedal positions and noise and generates an output analog voltage combining these various expressions and delivering the same to a control input of a voltage controlled amplifier 53 disposed between the source select and the destination select circuits 31 and 32.

A modulation depth control can also be provided in the form of another voltage controlled amplifier 54 in series with the VCA 53 and having its control input provided with appropriate means for delivering a modulation thereto e.g. from preprogrammed or otherwise selected instructions.

The output of the sources is thus modulated by VCA 53 in response to the creative expression inputs and further in response to the modulation depth of VCA 54.

Figure 4:
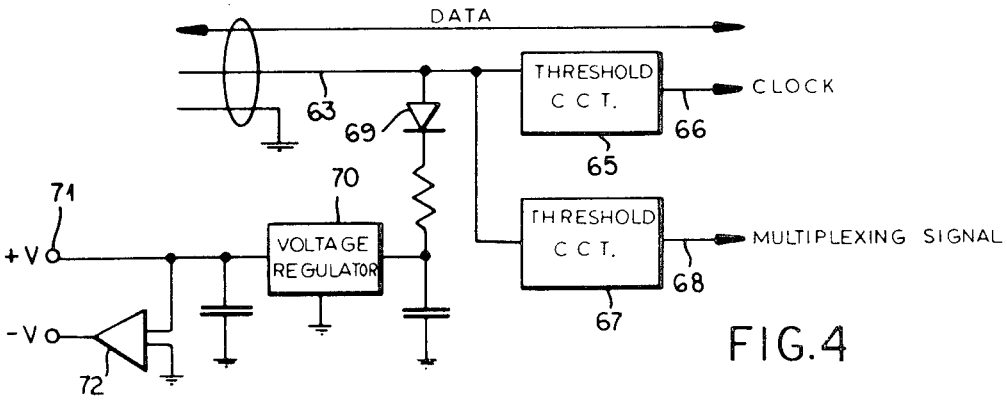
FIG. 4 is another block diagram illustrating circuitry utilized in the keyboard.

In FIG. 4 I have shown only the principles permitting use of the three-wire microphone cable connection between the keyboard 11 and the synthesizer 10, thereby permitting an audio cable customarily available to be used for this purpose and eliminating the need to hunt up or construct complex multiwire cables as hitherto been the case in most keyboard controlled synthesizer applications. The power line 63 is connected to a threshold circuit 65 from which the clock pulses are derived at 66 and to another threshold circuit 67 which outputs a sequence of control signals at 68, referred to as multiplexing signals here since they can be used for commutating the data from the keyboard to the various sources of the synthesizer circuit. The voltage level upon which the pulses are superimposed is tapped by the level detector diode 69 and fed to a voltage regulator 70 to output, for example, the positive supply voltage at 71. The inverter can be used at 72 to provide the negative voltage of the power required by the keyboard.

While thus far the invention has been described as it applies to an expression generating system for the keyboard as a whole, it has been found to be advantageous, in many cases, to provide individual expression generators for each of the keys of the keyboard, in addition to the expression generator for the keyboard as a whole or in place of the latter. When such individual expression generators are used, they may respond to a lesser pressure than the gross pressure applied to the keyboard as a whole so that modulation of the particular selected note is possible directly at the key.

Figure 5:
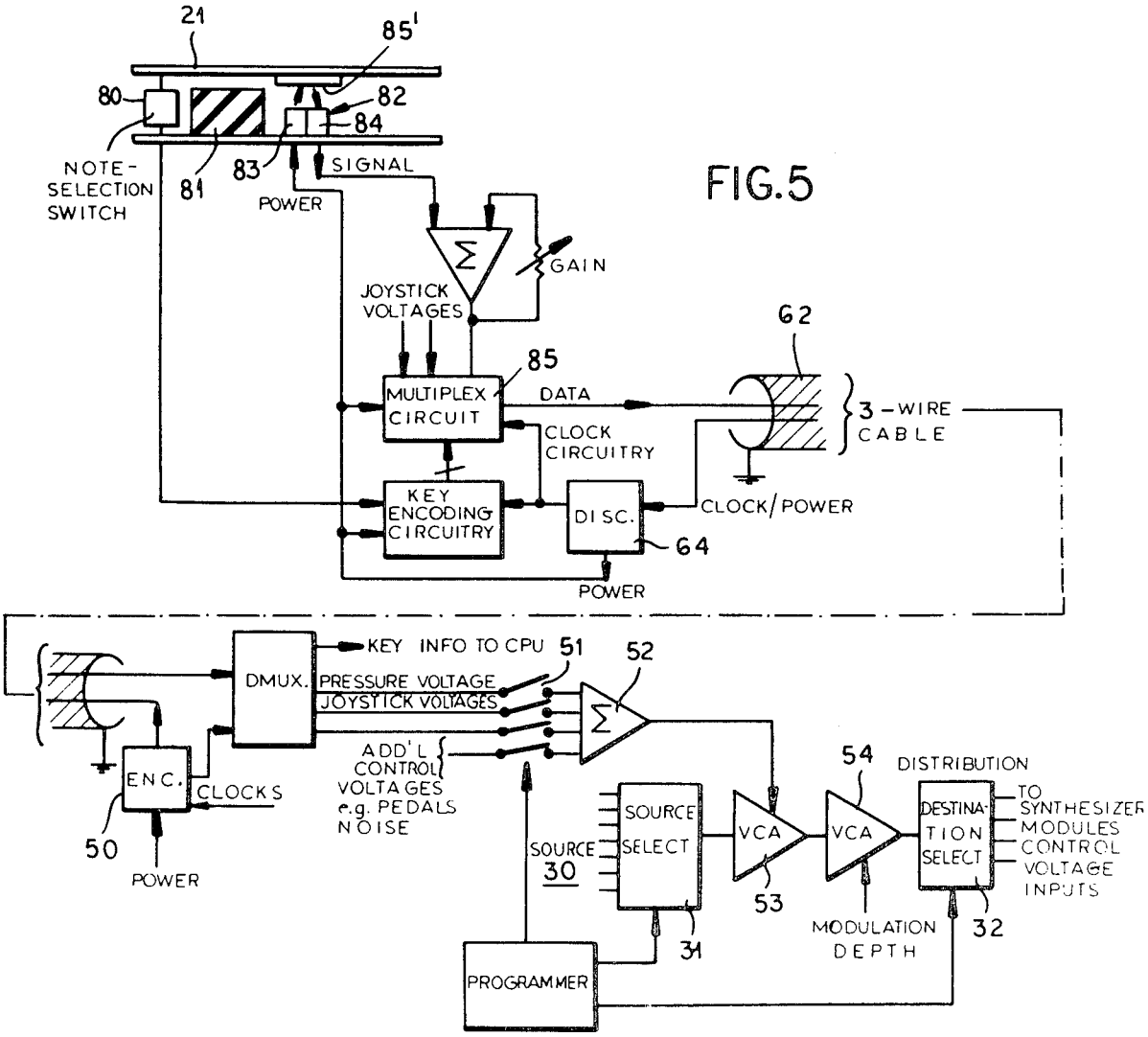
FIG. 5 is a diagrammatic cross sectional view illustrating an embodiment of the invention in which each key of the keyboard can be provided with an infrared system for modulating a signal by pressure, i.e. an individual key expression system.

In FIG. 5, I have shown a system in which the note detection key 21, which can be connected to the note selector switch 80 in the usual manner, can, after a brief stroke, come to rest against a compressible rubber pad 81 so that any further displacement of the key will compress this pad. A further displacement of the key can bring into play an optical unit 82 of the type previously described, including an LED or emitter source 83 and a photodetector 84, the beam being selected from the surface 85 on the underside of the key.

Naturally, this system operates in the manner described except that the outputs of the individual photodetectors 84 may be multiplexed for transmission along the data line of the keyboard cable by the multiplex switching represented at 85.

Naturally, the expression provided for each note may be further modified by modulating the input to the emitter 83 of the system as has also been described previously.

Figure 6:
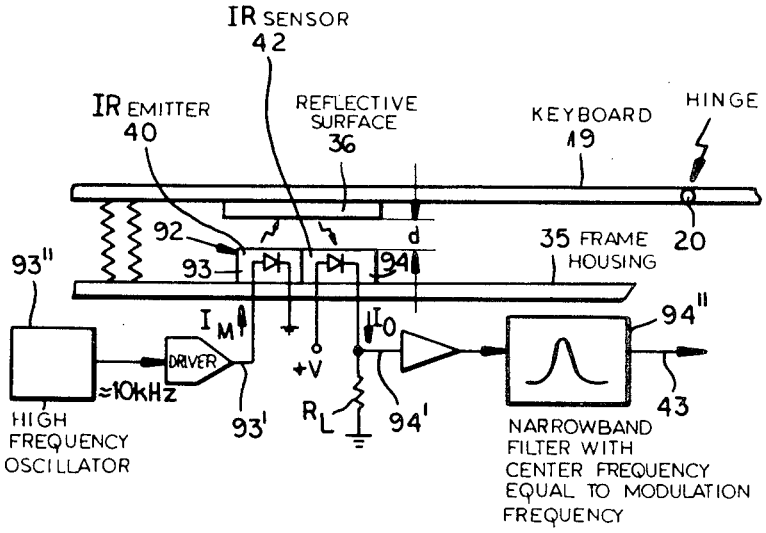
FIG. 6 is a diagram illustrating another feature of the invention.

In FIG. 6, I have shown in block diagram from a circuit which is especially advantageous for calibration of the device, whether it is to be used for individual keys, for the keyboard as a whole or both.

In this case, the unit 92 has its emitter 93 connected to the usual power source 93' as well as to a high frequency oscillator 93'' operating, for example, at 10 kHz to apply a modulating signal. The output 94' of the photodetector side of the unit is passed through a filter 94''. The latter can be a narrow bandpass filter centered to the modulation frequency. This circuit allows calibration of the unit when the keyboard is open and an ambient light situation without the need for special fixtures or the like precluding interference by ambient light.

I claim:

1. In an electronic music synthesizer having a keyboard and circuitry responsive to said keyboard for generating tones upon the operation of keys thereof, and means for modulating said tones in response to the pressure applied to the keyboard during the operation of the keys thereof, the improvement wherein said keyboard comprises a movable member displaced upon operation of the keys thereof and a stationary member juxtaposed with said movable member, said modulating means including an infrared source on one of said members, a reflective surface on the other of said members, and an infrared detector receiving infrared energy reflected from said surface for outputting a signal representing the path length of said infrared energy from said source to said detector, said modulating means being responsive to said signal.

2. The improvement defined in claim 1 wherein said infrared source and said detector are provided in a common module.

3. The improvement defined in claim 2 wherein two such modules are provided at opposite ends of said keyboard, further comprising an adder for receiving signals from both said modules and delivering a summation signal to said modulating means.

4. The improvement defined in claim 1 wherein said modulating means includes a voltage controlled amplifier.

5. The improvement defined in claim 4 wherein said circuitry includes a multiplicity of signal sources, a source select multiplexer connected to said sources, said voltage controlled amplifier being connected to said source select multiplexer, and a destination select multiplexer receiving an input from said voltage controlled amplifier and delivering outputs to respective destinations.

6. The improvement defined in claim 5, further comprising a modulation depth voltage controlled amplifier in series with the first mentioned voltage controlled amplifier and with said destination select multiplexer.

7. The improvement defined in claim 1 wherein said keyboard is connected by a three-conductor microphone cable with said circuitry, one conductor of said cable carrying a combined power and control-pulse signal, another conductor of said cable being ground and a third conductor of said cable being a data conductor.

8. The improvement defined in claim 6 wherein said keyboard is connected by a three-conductor microphone cable with said circuitry, one conductor of said cable carrying a combined power and control-pulse signal, another conductor of said cable being ground and a third conductor of said cable being a data conductor.

9. The improvement defined in claim 8 wherein said keyboard is provided with circuitry for separating said combined signal into a power signal and a train of control pulses.

10. The improvement defined in claim 9, further comprising a sensitivity control on said keyboard for adjusting the level of the signal delivered by said I-R detector of said modulation means.

11. The improvement defined in claim 1 wherein said movable member is one of said keys.

12. The improvement defined in claim 1 wherein said movable member is a support for one of said keys.

13. The improvement defined in claim 1, further comprising means for applying a high frequency signal to said infrared source and a narrow bandpass filter centered on the frequency of said source connected to said detector for outputting a signal enabling calibration of said modulating means in ambient light.

14. In an electronic music synthesizer having a keyboard and circuitry responsive to said keyboard for generating tones upon the operation of keys thereof, and means for modulating said tones in response to pressure applied during the operation of the keys, the improvement wherein said modulating means includes a respective infrared source and a respective infrared detector juxtaposed with a reflective surface of each of said keys, whereby for each key said source generates a ray of infrared energy which is reflected by said surface to said detector, and circuit means responsive to the output of said detector for modulating a tone selected by the respective key in accordance with pressure applied thereon and variation of the proximity of said surface to said modulating means.

15. The improvement defined in claim 14, further comprising multiplexing means in circuit with the outputs of said detectors of said keys for transmitting modulating signals along a data line connecting said keyboard to said synthesizer.

16. The improvement defined in claim 15, further comprising an infrared source and detector responsive to pressure applied to the keyboard as a whole, for modulating signal supplied to said synthesizer in response to the latter pressure.

* * * * *